US009698553B2

(12) United States Patent
Sugimoto et al.

(10) Patent No.: US 9,698,553 B2
(45) Date of Patent: Jul. 4, 2017

(54) METHOD FOR MANUFACTURING TERMINAL-FITTED WIRE

(71) Applicant: Sumitomo Wiring Systems, Ltd., Yokkaichi, Mie (JP)

(72) Inventors: Kenichi Sugimoto, Mie (JP); Kazuo Toita, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/984,099

(22) Filed: Dec. 30, 2015

(65) Prior Publication Data

US 2016/0111842 A1 Apr. 21, 2016

Related U.S. Application Data

(62) Division of application No. 14/131,547, filed as application No. PCT/JP2012/052806 on Feb. 8, 2012, now Pat. No. 9,543,726.

(30) Foreign Application Priority Data

Jul. 26, 2011 (JP) ..... 2011-163457

(51) Int. Cl.
*H01R 43/048* (2006.01)
*H01R 43/058* (2006.01)
*H01R 4/20* (2006.01)

(52) U.S. Cl.
CPC ..... *H01R 43/048* (2013.01); *H01R 4/203* (2013.01); *H01R 43/058* (2013.01); *H01R 4/20* (2013.01);
(Continued)

(58) Field of Classification Search
CPC ..... H01R 43/048; H01R 43/0486; H01R 43/0488; H01R 4/20; H01R 4/203; H01R 43/058; Y10T 29/49185; Y10T 29/53235
See application file for complete search history.

(56) References Cited

U.S. PATENT DOCUMENTS 2,535,013 A * 12/1950 Freedom ..... H01R 4/20 140/113
2,557,126 A 6/1951 Macy
(Continued)

FOREIGN PATENT DOCUMENTS

DE 10343837 6/2005
DE 600 20 304 T2 * 5/2006
(Continued)

OTHER PUBLICATIONS

European Patent Appl. No. 12 817 568.4—European Search Report issued Nov. 17, 2014.
International Search Report dated Mar. 28, 2012.

*Primary Examiner* — Carl Arbes
(74) *Attorney, Agent, or Firm* — Gerald E. Hespos; Michael J. Porco; Matthew T. Hespos

(57) ABSTRACT

A crimping die includes a first die for constraining the wire crimping portion by a concave die surface shaped in conformity with the wire crimping portion, and a second die including a convex die surface paired with the concave die surface. A width of a recess on the concave die surface and that of a projection on the convex die surface are equal to an outer diameter of the wire crimping portion. The wire crimping portion is pressed by the concave die surface of the first die and the convex die surface of the second die, whereby the wire crimping portion and the wire inserted into the cylindrical interior of the wire crimping portion are crimped and fixed.

1 Claim, 13 Drawing Sheets

(52) U.S. Cl.
CPC .... *Y10T 29/49185* (2015.01); *Y10T 29/53235* (2015.01)

(56) References Cited

U.S. PATENT DOCUMENTS

| | | | | | |
|---|---|---|---|---|---|
| 2,693,216 | A | * | 11/1954 | Broske | H01R 4/20 29/863 |
| 2,795,769 | A | | 6/1957 | Wells | |
| 2,965,147 | A | | 12/1960 | Hoffman | |
| 3,067,489 | A | * | 12/1962 | Hoffman | H01R 4/20 29/518 |
| 3,098,517 | A | * | 7/1963 | Zimmerman, Jr. | H01R 4/20 29/517 |
| 3,146,519 | A | * | 9/1964 | Redwine | H01R 43/058 174/84 C |
| 4,828,516 | A | * | 5/1989 | Shaffer | H01R 43/058 29/863 |
| 6,880,240 | B2 | * | 4/2005 | Kitagawa | H01R 43/048 29/751 |
| 2008/0141753 | A1 | | 6/2008 | Wightman et al. | |
| 2010/0206631 | A1 | | 8/2010 | Peters et al. | |
| 2011/0136397 | A1 | | 6/2011 | Koga et al. | |

FOREIGN PATENT DOCUMENTS

| | | |
|---|---|---|
| JP | 6-48171 | 6/1994 |
| JP | 9-147929 | 6/1997 |
| JP | 11-040310 | 2/1999 |
| JP | 2010-153187 | 7/2010 |

* cited by examiner

FIG. 12

| Terminal Fitting | | Crimping Die | | Index | | |
|---|---|---|---|---|---|---|
| Outer Diameter (mm) | Thickness in Radial Direction (mm) | Die Width (mm) | Pressing Amount (mm) | Die Width/ Outer Diameter | Pressing Amount/Thickness In Radial Direction | Breakage Result |
| 4.25 | 1.0 | 3.10 | 0.25 | 0.73 | 0.25 | × |
| 4.25 | 1.0 | 3.85 | 0.25 | 0.91 | 0.25 | × |
| 2.65 | 0.5 | 2.65 | 0.1 | 1.00 | 0.20 | ○ |
| 3.40 | 0.7 | 3.40 | 0.25 | 1.00 | 0.36 | ○ |
| 4.85 | 1.0 | 4.85 | 0.35 | 1.00 | 0.35 | ○ |
| 3.05 | 0.7 | 3.05 | 0.25 | 1.00 | 0.36 | ○ |
| 3.40 | 0.7 | 3.85 | 0.25 | 1.13 | 0.36 | × |
| 3.65 | 0.7 | 4.20 | 0.25 | 1.15 | 0.36 | × |

FIG. 13

| Terminal Fitting | | Crimping Die | | Index | | |
|---|---|---|---|---|---|---|
| Outer Diameter (mm) | Thickness in Radial Direction (mm) | Die Width (mm) | Pressing Amount (mm) | Die Width/ Outer Diameter | Pressing Amount/Thickness In Radial Direction | Breakage Result |
| 3.05 | 0.7 | 3.05 | 0 | 1.00 | 0.00 | ○ |
| 2.65 | 0.5 | 2.65 | 0 | 1.00 | 0.00 | ○ |
| 2.25 | 0.3 | 2.25 | 0 | 1.00 | 0.00 | ○ |
| 2.65 | 0.5 | 2.65 | 0.1 | 1.00 | 0.20 | ○ |
| 4.85 | 1.0 | 4.85 | 0.35 | 1.00 | 0.35 | ○ |
| 3.05 | 0.7 | 3.05 | 0.25 | 1.00 | 0.36 | ○ |
| 3.40 | 0.7 | 3.40 | 0.25 | 1.00 | 0.36 | ○ |
| 2.65 | 0.5 | 2.65 | 0.25 | 1.00 | 0.50 | × |
| 2.25 | 0.3 | 2.25 | 0.25 | 1.00 | 0.83 | × |

METHOD FOR MANUFACTURING TERMINAL-FITTED WIRE

The present application is a divisional application of U.S. patent application Ser. No. 14/131,547, filed Jan. 8, 2014, the contents of which are hereby incorporated by reference in their entirety.

BACKGROUND

1. Field of the Invention. This invention relates to a technique for crimping and fixing a wire and a terminal fitting.

2. Description of the Related Art. Conventionally, there is known a terminal-fitted wire including a wire in which a conductor wire is exposed at an end and a terminal fitting to be crimped and fixed to this end. The terminal fitting of the terminal-fitted wire takes various shapes, one of which includes a cylindrical wire crimping portion (so-called, closed barrel portion). Since this closed barrel-type terminal fitting has a high waterproof function, it is suitable for a connector likely to be used in an outdoor environment (e.g. charging connector of an electric vehicle) and the like.

Concerning closed barrel-type terminal fittings, a technique for crimping and fixing a wire and a terminal fitting by deforming a closed barrel portion under pressure in a state where a conductor wire of the wire is inserted in the closed barrel portion is disclosed, for example, in Japanese Unexamined Patent Publication No. 2010-153187 and Japanese Unexamined Utility Model Publication No. H06-48171.

SUMMARY OF THE INVENTION

In the terminal fitting, problems such as a conduction failure occur unless the conductor wire and the terminal fitting are reliably crimped and fixed by sufficiently deforming the barrel portion. However, if a degree of deformation increases, the terminal fitting is likely to be cracked or broken in being deformed. Particularly, since the closed barrel-type terminal fitting is formed by machining, it is formed using an easy-to-machine material (i.e. relatively brittle material). Thus, in compressing and deforming the closed barrel-type terminal fitting, the closed barrel portion is very likely to be cracked or broken and it has not been easy to achieve a crimped and fixed state ensuring electrical performance without causing cracks and breakage.

The present invention was developed in view of the above problem and an object thereof is to provide a technique capable of achieving a crimped and fixed state ensuring electrical performance while suppressing the occurrence of cracks and breakage in a terminal fitting including a cylindrical wire crimping portion.

A first aspect is directed to a crimping die, comprising a first die formed with a concave die surface for constraining a cylindrical wire crimping portion of a terminal fitting; and a second die formed with a convex die surface paired with the concave die surface; wherein a width of a recess on the concave die surface and that of a projection on the convex die surface are equal to an outer diameter of the wire crimping portion; and the wire crimping portion is sandwiched between the concave die surface and the convex die surface to be compressed and deformed, whereby the wire crimping portion and the wire inserted into the cylindrical interior of the wire crimping portion are crimped and fixed.

According to a second aspect, in the crimping die according to the first aspect, the first die includes a first protrusion standing on a bottom surface of the recess on the concave die surface and extending along a length direction perpendicular to a width direction of the recess; and the second die includes a second protrusion standing on an upper end surface of the projection on the convex die surface and extending along a length direction perpendicular to a width direction of the recess.

According to a third aspect, in the crimping die according to the second aspect, a projecting height of each of the first and second protrusions is 10% or more and 36% or less of a thickness of the wire crimping portion in a radial direction.

According to a fourth aspect, in the crimping die according to any one of the first to third aspects, the bottom surface of the recess includes a first inclined surface part inclined in a depth direction of the recess toward an end part in the length direction; the upper end surface of the projection includes a second inclined surface part inclined in a direction opposite to a projecting direction of the projection toward an end part in the length direction; and each of the first and second inclined surface parts is shaped such that an angle of inclination discontinuously changes to increase toward the end part.

A fifth aspect is directed to a terminal-fitted wire manufacturing method for manufacturing a terminal-fitted wire by crimping and fixing a terminal fitting including a cylindrical wire crimping portion and a wire, comprising a) a step of inserting the wire into the cylindrical interior of the wire crimping portion; b) a step of arranging the wire crimping portion between a concave die surface formed on a first die and a convex die surface formed on a second die; and c) a step of compressing and deforming the wire crimping portion and crimping and fixing the wire crimping portion and the wire inserted in the cylindrical interior of the wire crimping portion by sandwiching the wire crimping portion between the concave die surface and the convex die surface, wherein a width of a recess on the concave die surface and that of a projection on the convex die surface are equal to an outer diameter of the wire crimping portion.

According to the first and fifth aspects, the width of the recess on the concave die surface of the first die and that of the projection on the convex die surface of the second die are equal to the outer diameter of the wire crimping portion. According to this configuration, since the wire crimping portion is deformed such that the length thereof in a vertical direction is reduced with the length thereof in the width direction kept constant, it is possible to achieve a crimped and fixed state ensuring electrical performance while suppressing the occurrence of cracks and breakage.

According to the second aspect, since the first protrusion is formed on the bottom surface of the recess on the concave die surface and the second protrusion is formed on the upper end surface of the projection on the convex die surface, the wire crimping portion is pressed at circumferential positions facing each other in the process of compressing and deforming the wire crimping portion and crimping and fixing it to the wire. This enables a crimped and fixed state reliably ensuring electrical performance to be achieved.

According to the third aspect, the projection height of each of the first and second protrusions is 10% or more and 36% or less of the thickness of the wire crimping portion in the radial direction. According to this configuration, it is possible to combine the suppression of the occurrence of cracks and breakage and good electrical performance.

According to the fourth aspect, each of the first and second inclined surface parts is shaped such that the angle of inclination discontinuously changes to increase toward the end part. Thus, the bellmouth portion formed by being sandwiched between these inclined surface parts has a shape gradually widened over multiple steps. Therefore, the bell-mouth portion is unlikely to be cracked or broken in the process of compressing and deforming the wire crimping portion and crimping and fixing it to the wire.

Objects, features, aspects and advantages of this invention become more apparent from the following detailed description and accompanying drawings.

BRIEF DESCRIPTION OF THE DRAWINGS

FIG. 12 is a table showing the result of a cracking test of terminal-fitted wires obtained by being compressed and deformed by crimping dies having mutually different die widths.

FIG. 13 is a table showing the result of a cracking test of terminal-fitted wires obtained at mutually different pressing amounts.

DETAILED DESCRIPTION OF THE PREFERRED EMBODIMENTS

Embodiments of the present invention are described with reference to the accompanying drawings. The following embodiment is a specific example of the present invention and not intended to limit the technical scope of the present invention. Note that a common XYZ orthogonal coordinate system is appropriately attached to each figure to be referred to in the following description to clarify a positional relationship and an operating direction of each member.

<1. Terminal-Fitted Wire 100>

Figure 1:
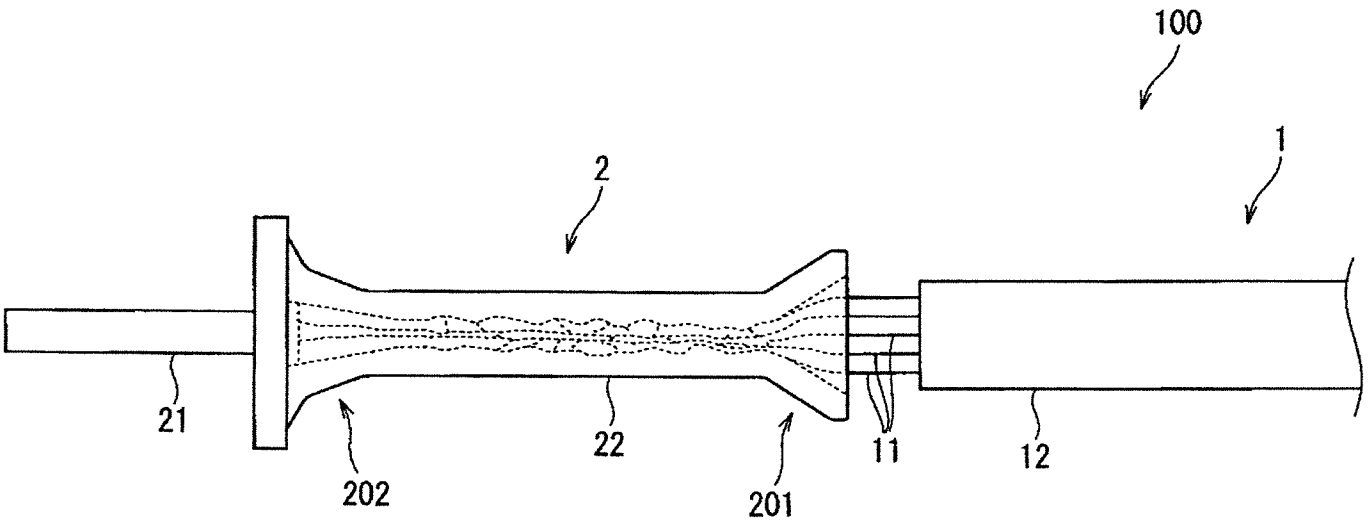
FIG. 1 is a side view in section diagrammatically showing a terminal-fitted wire.

A terminal-fitted wire 100 is described with reference to FIG. 1. FIG. 1 is a side view in section diagrammatically showing the terminal-fitted wire 100.

The terminal-fitted wire 100 includes a wire 1 and a terminal fitting 2 crimped to the wire 1. The wire 1 includes a plurality of conductor wires 11 arranged in a twisted state and an insulation coating 12 for covering the conductor wires 11 with an insulator. The wire 1 is in such a state where the insulation coating 12 is partly removed at an end to expose the conductor wires 11 and the terminal fitting 2 is crimped and fixed to this end.

<2. Terminal Fitting 2>

Figure 2:
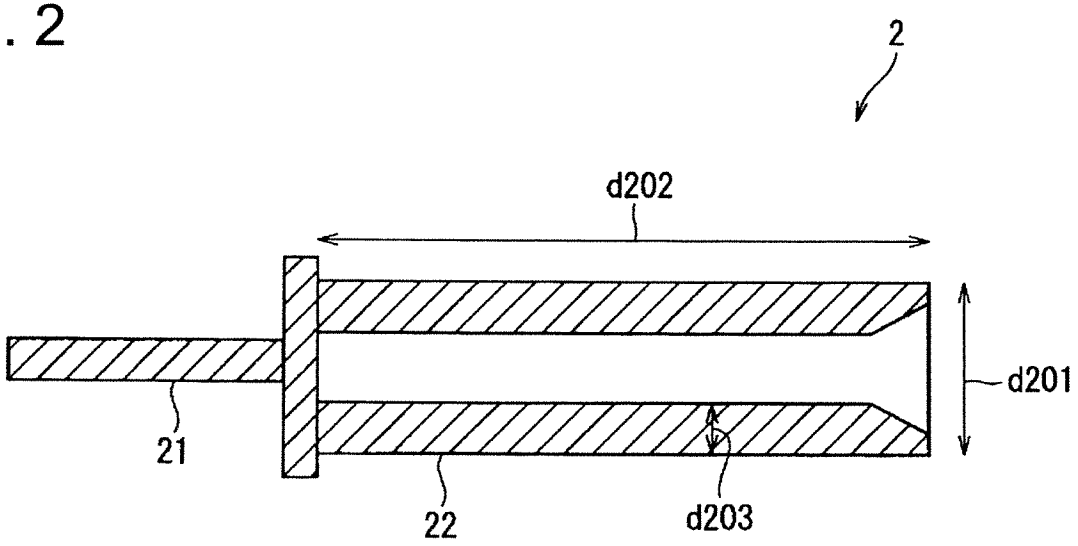
FIG. 2 is a side view in section diagrammatically showing a terminal fitting before being crimped and fixed to a wire.

The terminal fitting 2 is described with reference to FIG. 2 in addition to FIG. 1. FIG. 2 is a side view in section diagrammatically showing the terminal fitting 2 before being crimped and fixed to the wire 1.

The terminal fitting 2 includes an electrical contact portion 21 and a wire crimping portion 22. The electrical contact portion 21 is formed into a shape (e.g. pin-shape, ring-shape) fittable into a mating terminal. The wire crimping portion 22 is a wire barrel portion to be crimped and fixed to the conductor wires 11 and formed into a cylindrical shape.

The terminal fitting 2 including the cylindrical wire crimping portion 22 (so-called "closed barrel") is generally formed by machining. Thus, the terminal fitting 2 is made of an easy-to-machine material (e.g. brass (e.g. material code C2801 of JIS (Japanese Industrial Standards)), free-machining brass (e.g. material code C3604 of JIS (Japanese Industrial Standards))). Since free-machining brass has better machinability than brass, processing cost is suppressed. On the other hand, since free-machining brass is more brittle than brass, it has a drawback of easy crack and breakage in being compressed and deformed. Thus, free-machining brass has been less likely to be used as the material of the terminal fitting 2. However, as will become clear later, according to a crimping and fixing mode using a crimping die 3, a proper crimped and fixed state ensuring reliable electrical performance can be achieved without cracking or breaking the wire crimping portion 22 even if the terminal fitting 2 is made of a relatively brittle material such as free-machining brass.

<3. Manufacturing of Terminal-Fitted Wire 100>

A mode of manufacturing the terminal-fitted wire 100 is described. The terminal-fitted wire 100 is manufactured by compressing and deforming the wire crimping portion 22 and crimping and fixing the conductor wires 11 and the wire crimping portion 22 using the crimping die 3 in a state where the conductor wires 11 of the wire 1 are inserted in the wire crimping portion 22 of the terminal fitting 2 (see FIGS. 9 and 10). The crimping die 3 used to compress and deform the wire crimping portion 22 is specifically described below.

<3-1. Crimping Die 3>

The crimping die 3 includes a first die (upper die) 4 and a second die (lower ide) 5.

<First Die 4>

Figure 3:
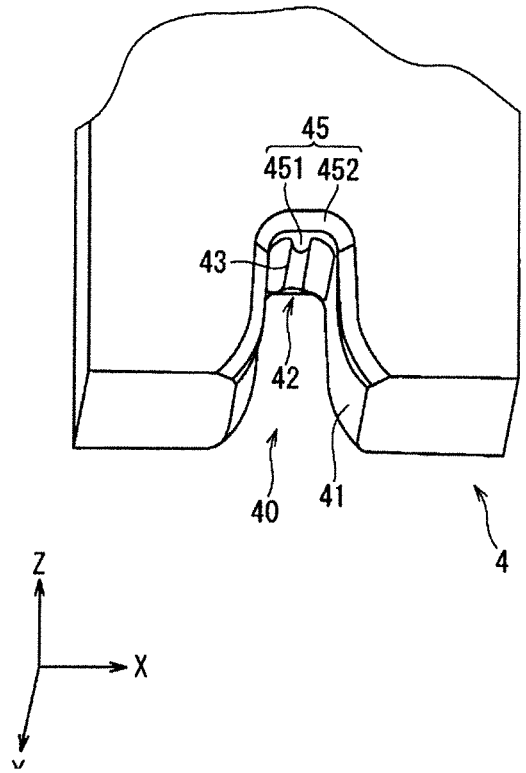
FIG. 3 is a perspective view diagrammatically showing a first die.
Figure 4:
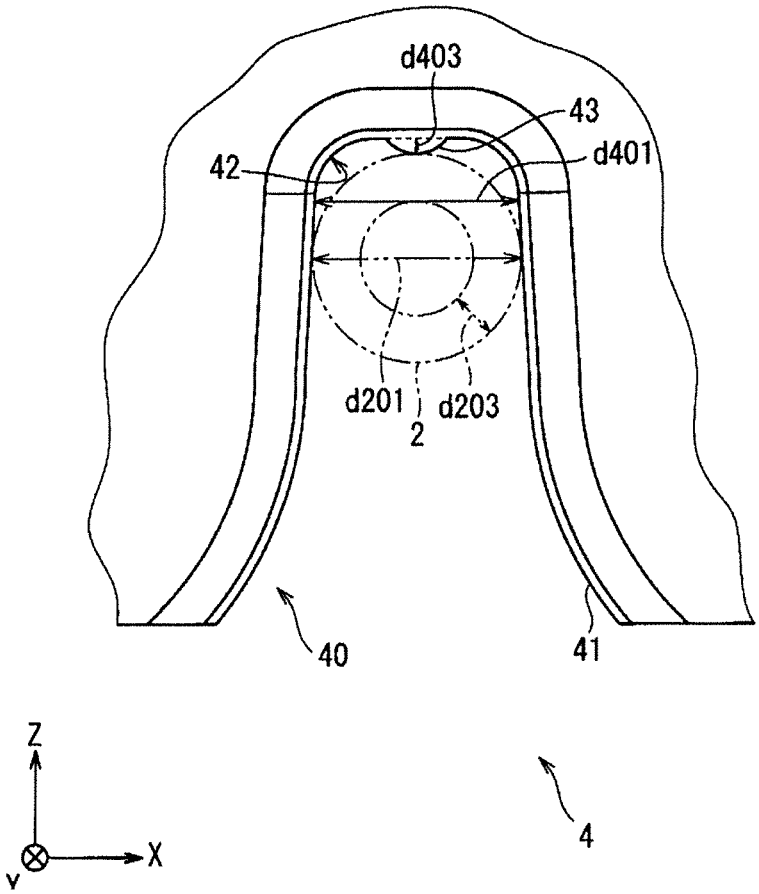
FIG. 4 is a front view diagrammatically showing a part of the first die.
Figure 5:
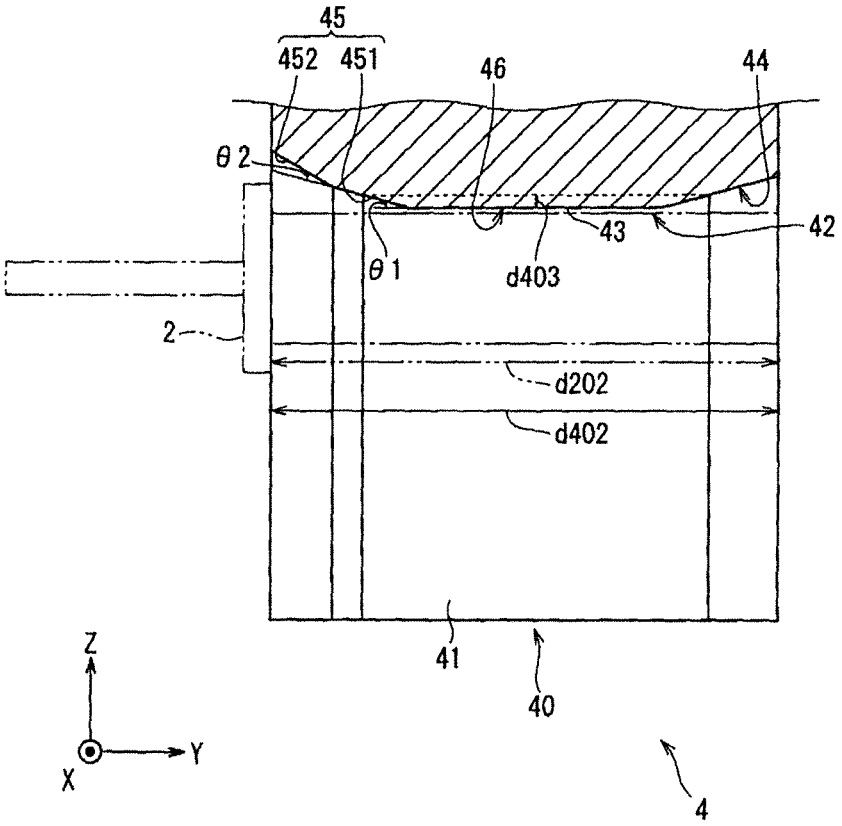
FIG. 5 is a side view in section diagrammatically showing the first die.

The configuration of the first die 4 is described with reference to FIGS. 3 to 5. FIG. 3 is a perspective view diagrammatically showing the first die 4. FIG. 4 is a front view diagrammatically showing a part of the first die 4. FIG. 5 is a side view in section diagrammatically showing the first die 4. Note that the terminal fitting 2 is shown in imaginary line in FIGS. 4 and 5 to show a relationship between dimensions of each part of the first die 4 and dimensions of each part of the terminal fitting 2.

The first die 4 includes a concave die surface 40 formed on the lower end surface (−Z side surface) thereof.

The concave die surface 40 includes a recess 41 which is formed near a central part in a width direction (X direction) thereof and open on both ends in a length direction (Y direction) and one end (−Z side end) in a depth direction (Z direction). The recess 41 is shaped in conformity with the wire crimping portion 22 and the concave die surface 40 constrains the wire crimping portion 22 in this recess 41.

A length d401 of the recess 41 in a width direction (X direction) thereof is equal to an outer diameter d201 of the wire crimping portion 22. Further, a length d402 of the recess 41 in a length direction (Y direction) thereof is equal to a length d202 of the wire crimping portion 22 in an extending direction thereof. Note that the recess 41 is preferably formed into such a shape spreading toward the bottom that the length in the width direction is slightly longer near a −Z side opening end. However, areas of a pair of side wall surfaces of the recess 41 including areas X (see FIG. 9), with which both ends (both ends of a center line vertically bisecting a cross-section (cross-section along a radial direction) of the wire crimping portion 22) of the wire crimping portion 22 in a width direction (X direction) thereof come into contact in the process of crimping and deforming the wire crimping portion 22, form parallel surface parts extending in parallel to each other in the depth direction. The width d401 of the recess 41 described above indicates a distance between the pair of side wall surfaces on these parallel surface parts.

A bottom surface (+Z side end surface) 42 of the recess 41 is smoothly connected at both ends in the width direction (X direction) thereof to the side wall surfaces of the recess 41 via moderate curves, and a cross-section thereof along the width direction has a substantially semi-elliptical shape. Further, a protrusion (first protrusion) 43 extending in a length direction (Y direction) of the bottom surface 42 stands in a widthwise central part of the bottom surface 42. The tip of the first protrusion 43 viewed in an extending direction thereof has an arcuate shape and a projection height d403 of a part with a longest projection height is 10% or more and 36% or less of a thickness d203 of the wire crimping portion 22 in the radial direction.

Further, the bottom surface 42 includes inclined surface parts 44, 45 respectively formed near end parts in the length direction thereof and a flat surface part 46 formed between the inclined surface parts 44 and 45. Each inclined surface part 44, 45 is a surface part inclined in the depth direction (+Z direction) of the recess 41 toward the end part in the length direction of the bottom surface 42. On the other hand, the flat surface part 46 is a surface part extending in the length direction of the bottom surface 42 without being inclined in the depth direction.

Here, one inclined surface part (+Y side inclined surface part) 44 has a constant angle of inclination. An angle between this inclined surface part 44 and the flat surface part 46 is preferably smaller than 30° and can be, for example, set at 15°.

An angle of inclination of the other inclined surface part (hereinafter, also referred to as a "first multi-step inclined surface part") 45 discontinuously changes to increase toward the end part. Specifically, the first multi-step inclined surface part 45 includes a first step inclined portion 451 connected to the flat surface part 46 and obliquely extending at an angle θ1 in the depth direction with respect to the flat surface part 46 and a second step inclined portion 452 connected to the first step inclined portion 451 and obliquely extending at an angle θ2 in the depth direction with respect to the first step inclined portion 451 (i.e. inclined at an angle (θ1+θ2) in the depth direction with respect to the flat surface part 46). The angle θ1 between the first step inclined portion 451 and the flat surface part 46 is preferably smaller than 30° and can be, for example, set at 15°. Further, the angle θ2 between the second step inclined portion 452 and the first step inclined portion 451 is also preferably smaller than 30° and can be, for example, set at 15°. A shape whose angle of inclination discontinuously changes to increase has an advantage of easy processing (easy manufacturing) as compared with a shape whose angle of inclination continuously changes to increase.

<Second Die 5>

Figure 6:
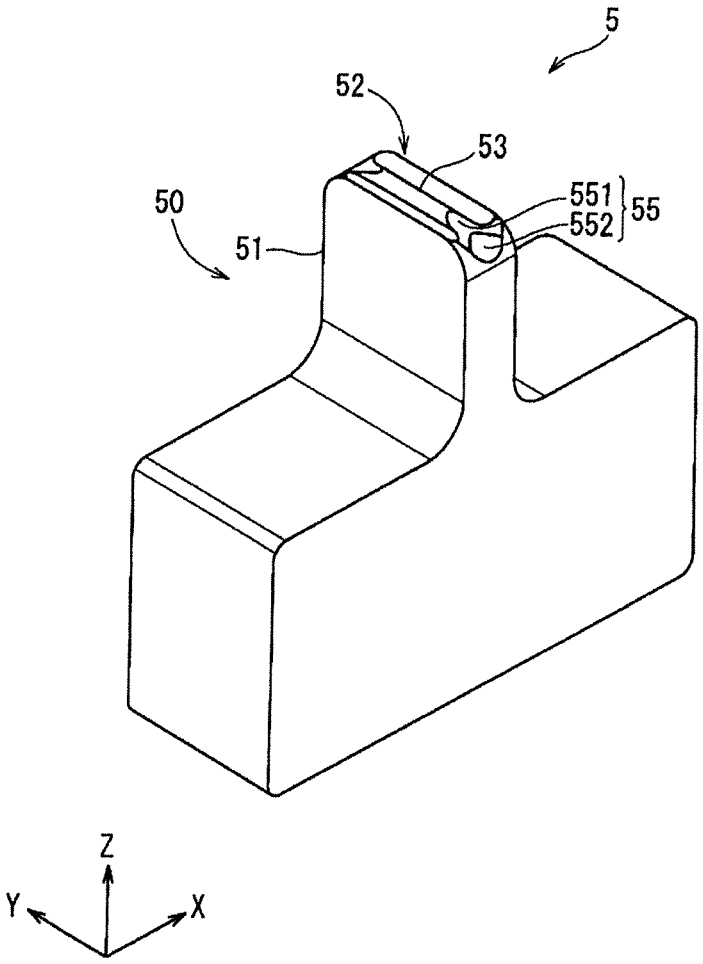
FIG. 6 is a perspective view diagrammatically showing a second die.
Figure 7:
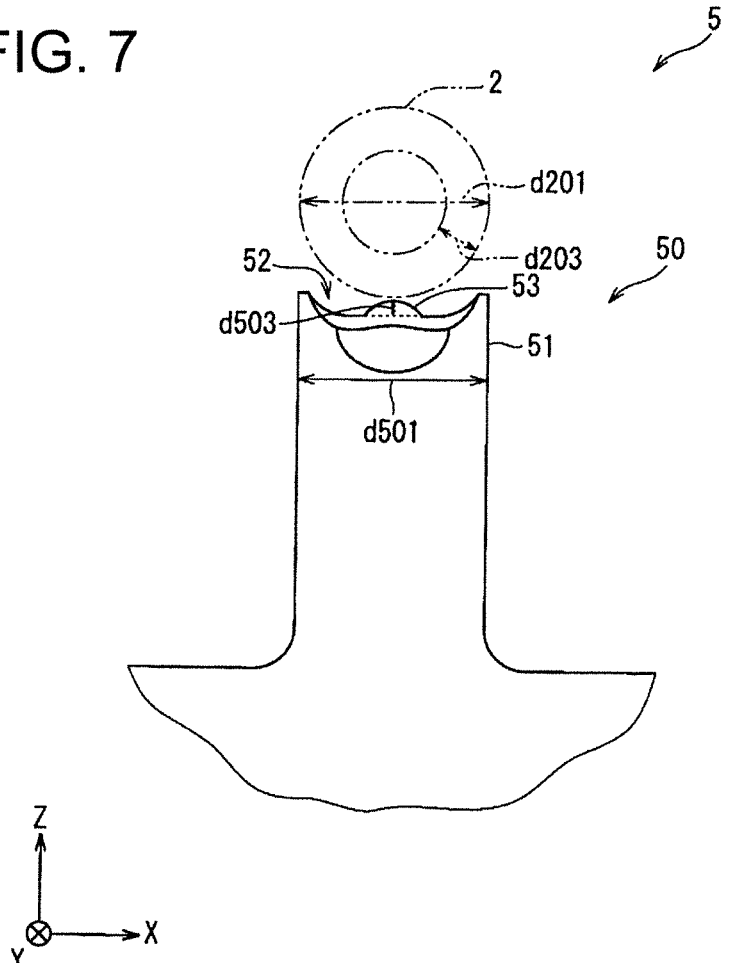
FIG. 7 is a front view diagrammatically showing a part of the second die.
Figure 8:
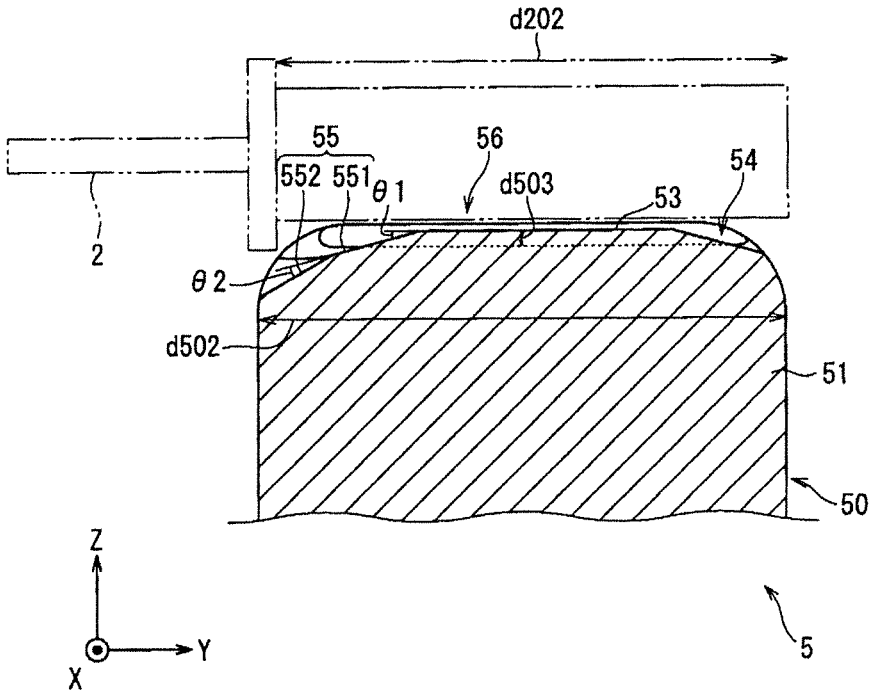
FIG. 8 is a side view in section diagrammatically showing the second die.

The configuration of the second die 5 is described with reference to FIGS. 6 to 8. FIG. 6 is a perspective view diagrammatically showing the second die 5. FIG. 7 is a front view diagrammatically showing a part of the second die 5. FIG. 8 is a side view in section diagrammatically showing the second die 5. Note that the terminal fitting 2 is shown in imaginary line in FIGS. 7 and 8 to show a relationship between dimensions of each part of the second die 5 and dimensions of each part of the terminal fitting 2.

The second die 5 includes a convex die surface 50 formed on the upper end surface (+Z side surface) thereof.

The convex die surface 50 includes a projection 51 formed near a central part along a width direction (X direction) thereof. The projection 51 is shaped in conformity with the recess 41 and formed to be insertable into the recess 41.

A length d501 of the projection 51 in the width direction (X direction) thereof is equal to the outer diameter d201 of the wire crimping portion 22. Further, a length d502 of the projection 51 in a length direction (Y direction) thereof is equal to the length d202 of the wire crimping portion 22 in the extending direction thereof. Note that the projection 51 may be formed into such a shape spreading toward the bottom that the length in the width direction near the lower end is slightly longer than the length d501 in the width direction near the upper end. However, the projection 51 is formed to have a constant thickness in the width direction at least near the upper end thereof, and the length of an upper end surface (+Z side end surface) 52 of the projection 51 in the width direction (X direction) is equal to the length d501 of the projection 51 in the width direction. Specifically, the length of the upper end surface 52 of the projection 51 in the width direction is equal to the outer diameter d201 of the wire crimping portion 22.

The upper end surface 52 of the projection 51 is in a vertically inverted shape of the bottom surface 42 of the recess 41. Specifically, the upper end surface 52 is moderately warped upward at both ends in the width direction and a cross-section thereof along the width direction has a substantially semi-elliptical shape. Further, a protrusion (second protrusion) 53 extending along a length direction (Y direction) of the upper end surface 52 stands in a widthwise central part of the upper end surface 52. The tip of the second protrusion 53 viewed in an extending direction thereof has an arcuate shape and a projection height d503 of a part with a longest projection height is 10% or more and 36% or less of the thickness d203 of the wire crimping portion 22 in the radial direction.

Further, the upper end surface 52 includes inclined surface parts 54, 55 respectively formed near end parts in the length direction thereof and a flat surface part 56 formed between the inclined surface parts 54 and 55. Each inclined surface part 54, 55 is a surface part inclined in a direction (−Z direction) opposite to a projecting direction of the projection 51 toward the end part in the length direction of the upper end surface 52. On the other hand, the flat surface part 56 is a surface part extending in the length direction of the upper end surface 52 without being inclined in the projecting direction of the projection 51.

Here, one inclined surface part (+Y side inclined surface part) 54 has a constant angle of inclination. An angle between this inclined surface part 54 and the flat surface part 56 is preferably smaller than 30° and can be, for example, set at 15°.

An angle of inclination of the other inclined surface part (hereinafter, also referred to as a "second multi-step inclined surface part") 55 discontinuously changes to increase toward the end part. Specifically, the second multi-step inclined surface part 55 includes a first step inclined portion 551 connected to the flat surface part 56 and obliquely extending at the angle θ1 in the depth direction with respect to the flat surface part 56 and a second step inclined portion 552 connected to the first step inclined portion 551 and obliquely extending at the angle θ2 in the depth direction with respect to the first step inclined portion 551 (i.e. inclined at the angle (θ1+θ2) in the depth direction with respect to the flat surface part 56). The angle θ1 between the first step inclined portion 551 and the flat surface part 56 is preferably smaller than 30° and can be, for example, set at 15°. Further, the angle θ2 between the second step inclined portion 552 and the first step inclined portion 551 is also preferably smaller than 30° and can be, for example, set at 15°. As described above, a shape whose angle of inclination discontinuously changes to increase has an advantage of easy processing (easy manufacturing) as compared with a shape whose angle of inclination continuously changes to increase.

<3-2. Crimping Process>

Figure 9:
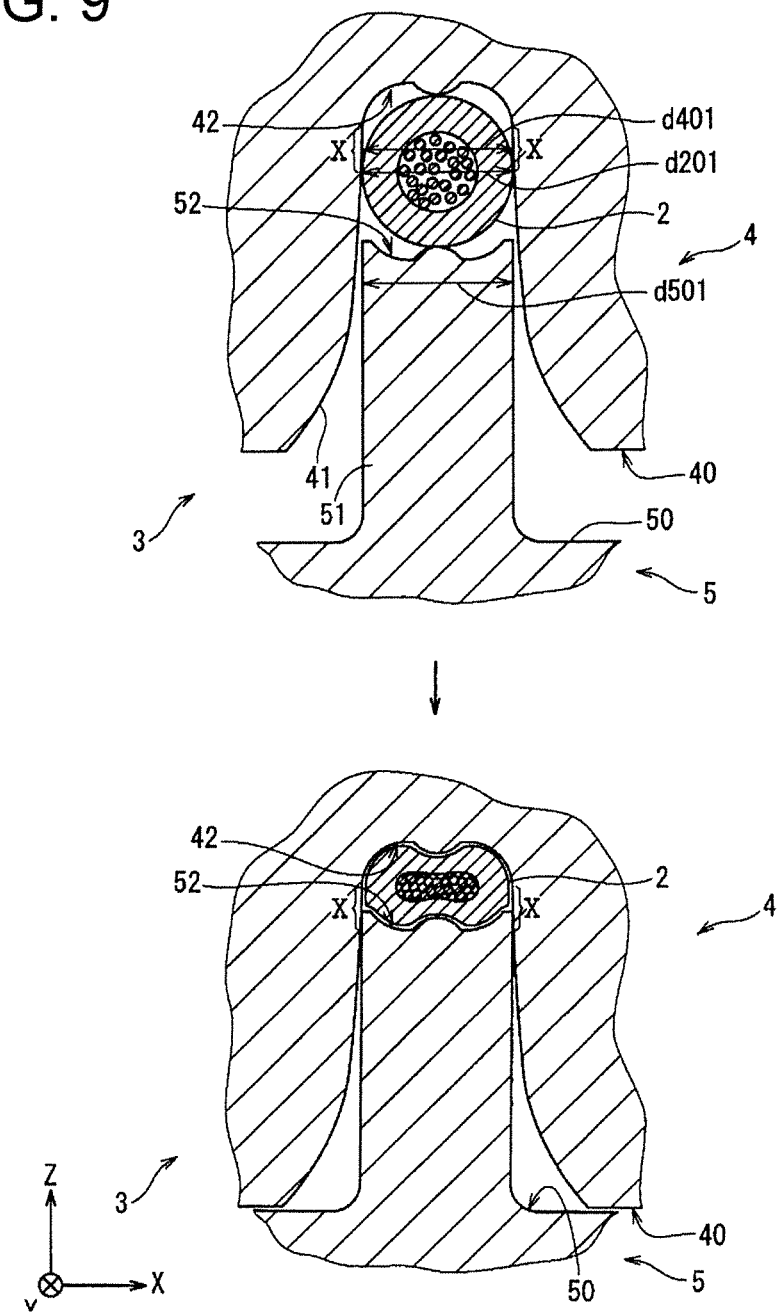
FIG. 9 is a view diagrammatically showing a state of a step of a crimping process.
Figure 10:
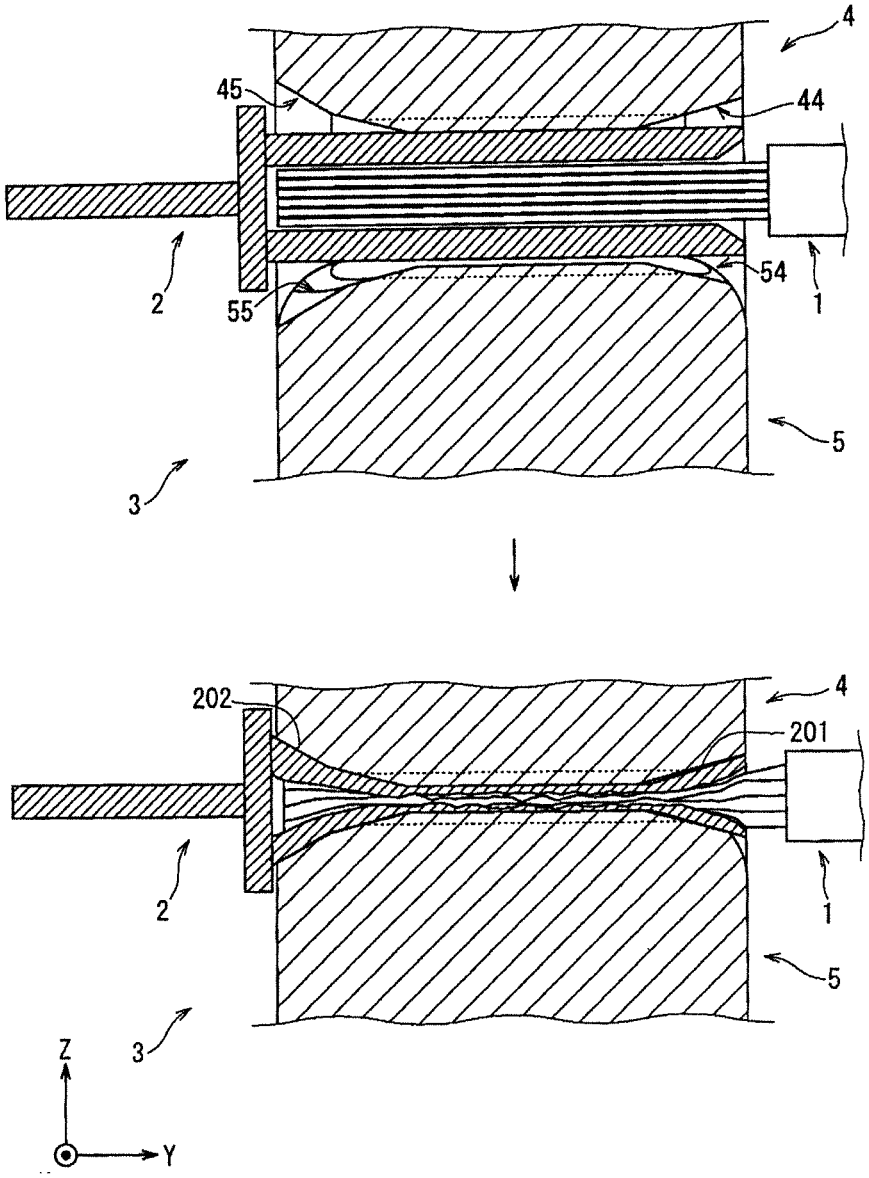
FIG. 10 is a view diagrammatically showing a state of a step of the crimping process.

Next, a process for manufacturing the terminal-fitted wire 100 using the crimping die 3 (crimping process) is described with reference to FIGS. 9 and 10. FIGS. 9 and 10 are views diagrammatically showing cross-sectional states of the crimping die 3 and the terminal fitting 2 in each step of the crimping process.

The first die 4 and the second die 5 are arranged while being vertically spaced apart with the concave die surface 40 and the convex die surface 50 vertically facing each other. One die (here, first die 4) is configured to be movable back and forth along a vertical axis relative to the fixedly supported other die (herein, second die 5).

In the crimping process, the conductor wires 11 are first inserted into the cylindrical interior of the wire crimping portion 22 of the terminal fitting 2. Subsequently, the wire crimping portion 22 having the conductor wires 11 inserted into the cylindrical interior is placed on the upper end surface 52 in such a posture that the extending direction of the wire crimping portion 22 is aligned with the length direction of the upper end surface 52 of the projection 51. This causes the wire crimping portion 22 to be arranged between the concave die surface 40 of the first die 4 and the convex die surface 50 of the second die 5. Note that the conductor wires 11 may be inserted into the wire crimping portion 22 after (or at the same time as) the wire crimping portion 22 is placed on the upper end surface 52.

Subsequently, the concave die surface 40 is brought closer to the convex die surface 50 by moving the first die 4 downward. Then, the wire crimping portion 22 placed on the projection 51 and the upper end surface 52 is guided into the recess 41 of the concave die surface 40. Note that if the recess 41 is formed to have a shape spreading toward the bottom, the projection 51 and the wire crimping portion 22 are smoothly guided into the recess 41.

When the first die 4 is moved further downward, the bottom surface 42 of the recess 41 comes into contact with the upper end (+Z side end) of the wire crimping portion 22 (state shown in upper parts of FIGS. 9 and 10). That is, in this state, the upper end of the wire crimping portion 22 is in contact with the bottom surface 42 and the lower end (−Z side end) thereof is in contact with the upper end surface 52. Further, as described above, since the length d401 of the recess 41 in the width direction and the length d501 of the projection 51 in the width direction are both substantially equal to the outer diameter of the wire crimping portion 22, the wire crimping portion 22 is, in this state, in contact with the side walls of the recess 41 at each of the both ends thereof in the width direction (X direction).

When the first die 4 is moved further downward, the wire crimping portion 22 is sandwiched between the concave die surface 40 and the convex die surface 50 to be compressed and deformed (state shown in lower parts of FIGS. 9 and 10). Specifically, the wire crimping portion 22 is compressed in the height direction thereof without changing the length thereof in the width direction, thereby being deformed to have a substantially elliptical shape. This causes the wire crimping portion 22 and the conductor wires 11 inserted in the cylindrical interior thereof to be crimped and fixed.

However, when being compressed and deformed between the concave die surface 40 and the convex die surface 50, the wire crimping portion 22 is pressed near a central part of the upper side thereof by the first protrusion 43 formed on the bottom surface 42 of the recess 41 and near a central part of the lower end side thereof by the second protrusion 53 formed on the upper end surface 52 of the projection 51. In this way, the occurrence of a crimp failure near the widthwise center of the wire crimping portion 22 is avoided and the wire crimping portion 22 is reliably crimped and fixed to the conductor wires 11.

Further, when the wire crimping portion 22 is compressed and deformed between the concave die surface 40 and the convex die surface 50, a widened portion 201 widened toward the end part is formed by the opening-side end part out of the end parts of the wire crimping portion 22 in the extending direction being sandwiched between the inclined surface part 44 formed on the bottom surface 42 and the inclined surface part 54 formed on the upper end surface 52. On the other hand, the end part on the side of the electrical contact portion 21 is sandwiched between the first multi-step inclined surface part 45 formed on the bottom surface 42 and the second multi-step inclined surface part 55 formed on the upper end surface 52, thereby forming a widened portion (bellmouth portion) 202 gradually widened over multiple steps toward the end part.

<4. Effects>

<4-1. Widths of Recess 41 and Projection 51>

In the crimping die 3, the width d401 of the recess 41 on the concave die surface 40 of the first die 4 and the width d501 of the projection 51 on the convex die surface 50 of the second die 5 are equal to the outer diameter d201 of the wire crimping portion 22. According to this configuration, since the wire crimping portion 22 is deformed to reduce the length in the vertical direction with the length in the width direction thereof kept constant in the process of being compressed and deformed, it is possible to achieve a crimped and fixed state ensuring electrical performance while suppressing the occurrence of cracks and breakage even if the terminal fitting 20 is made of a relatively brittle material such as free-machining brass.

Figure 11:
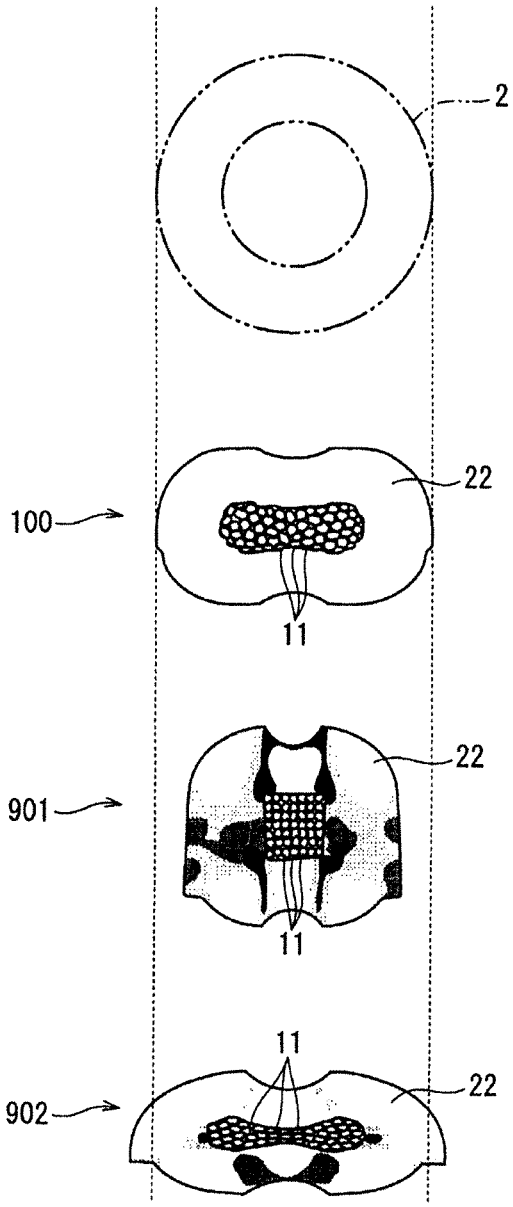
FIG. 11 is a view showing cross-sections of terminal-fitted wires obtained in mutually different crimped and fixed modes.

On this point, FIG. 11 diagrammatically shows a CAE (Computer Aided Engineering) analysis result on cross-sections of terminal-fitted wires obtained by crimping and fixing the terminal fitting 20 made of free-machining brass to the conductor wires 11 of the wire 1 in various different modes. In FIG. 11, parts undergoing a large distortion, which could cause breakage, are shown by hatching, wherein the darker the color, the larger the distortion. Note that the terminal fitting 2 before compressive deformation is shown in imaginary line in FIG. 11 to show a change in the width of the terminal fitting before and after compressive deformation.

A first terminal-fitted wire was the terminal-fitted wire 100 described above and manufactured using the crimping die 3. A second terminal-fitted wire (first comparative example) 901 was obtained by pressing bar-shaped dies or the like from four upper, lower, left and right sides against the wire crimping portion 22 having the conductor wires 11 inserted thereinto to compress and deform the wire crimping portion 22 and crimp and fix the wire crimping portion 22 to the conductor wires 11. A third terminal-fitted wire (second comparative example) 902 was obtained by sandwiching the wire crimping portion 22 between a concave die surface including a recess wider than the outer diameter of the wire crimping portion 22 and a convex die surface including a projection wider than the outer diameter of the wire crimping portion 22 to compress and deform the wire crimping portion 22 and crimp and fix the wire crimping portion 22 to the conductor wires 11.

In the first comparative example 901, the wire crimping portion 22 having a circular cross-section was deformed to have a substantially rectangular cross-section and a group of conductor wires 11 were crimped and fixed to the wire crimping portion 22 while being bundled to have a substantially rectangular cross-section. In this configuration, large distortions, which could cause breakage, were confirmed near parts of the wire crimping portion 22 pressed from the dies. Further, it was confirmed that cracks were likely to be formed in radial directions of the wire crimping portion 22 from corner parts of the bundled conductor wires 11. Further, it was confirmed that the outer surface of the wire crimping portion 22 was likely to be broken.

On the other hand, in the second comparative example 902, the wire crimping portion 22 was deformed such that the length in the vertical direction was reduced and the length in the width direction was increased, and a group of conductor wires 11 were crimped and fixed to the wire crimping portion 22 while being bundled to have a gourd-shaped cross-section constricted near the central part in the width direction. In this configuration, large distortions, which could cause breakage, were confirmed at opposite end parts of the wire crimping portion 22 in the width direction. Further, it was confirmed that cracks were likely to be formed in radial directions of the wire crimping portion 22 from end parts of the bundled conductor wires 11 in the width direction.

Contrary to these, in the terminal-fitted wire 100, the wire crimping portion 22 was deformed such that the length in the vertical direction was reduced with the length in the width direction kept constant, the cross-section thereof was changed from the circular one to the substantially elliptical one (shape obtained by connecting two semicircles by a straight line), and a group of conductor wires 11 were crimped and fixed to the wire crimping portion 22 while being bundled to have an elliptical cross-sectional shape substantially similar to that of the wire crimping portion 22. In this configuration, no part undergoing a large distortion, which could cause breakage, was confirmed in the wire crimping portion 22. Further, no crack extending in the radial direction of the wire crimping portion 22 from a boundary part between the conductor wires 11 and the wire crimping portion 22 was confirmed. Further, electrical performance was also confirmed.

FIG. 12 shows the result of a cracking test of terminal-fitted wires obtained by compressing and deforming terminal fittings 2 of various sizes made of free-machining brass respectively using crimping dies having different die widths. "Die width" means the width of a recess (i.e. width of a projection) of the crimping die. Note that, in a "breakage result" of FIG. 12, "?" is written when no breakage was confirmed and "x" is written when breakage was confirmed.

Also in this test, it was confirmed that no breakage occurred when the die width and the outer diameter of the wire crimping portion 22 was equal and breakage occurred when the die width was larger or smaller than the outer diameter of the wire crimping portion 22.

<4-2. Pressing>

Further, in the crimping die 3, the first protrusion 43 is formed on the bottom surface 42 of the recess 41 on the concave die surface 40 and the second protrusion 53 is formed on the upper end surface 52 of the projection 51 on the convex die surface 50. Thus, in the process of compressing and deforming the wire crimping portion 22 to crimp and fix it to the conductor wires 11, the wire crimping portion 22 is pressed at circumferential positions facing each other. This enables the crimped and fixed state reliably ensuring electrical performance to be achieved.

Note that pressing amounts by the first and second protrusions 43, 53 (specifically, height d403 of the first protrusion 43 and height d504 of the second protrusion 53) are preferably 10% or more and 36% or less of the thickness d203 of the wire crimping portion 22 in the radial direction as described above. According to this configuration, it is possible to easily and reliably combine the suppression of the occurrence of cracks and breakage and good electrical performance.

On this point, the result of a cracking test of terminal-fitted wires obtained by crimping and fixing terminal fittings 2 of various sizes made of free-machining brass to conductor wires 11 of wires 1 respectively at different pressing amounts is shown in FIG. 13.

In this test, no occurrence of breakage was confirmed when the pressing amount was 36% or less of the thickness d203 of the wire crimping portion 22 in the radial direction. On the other hand, when the pressing amount became 50% or more of the thickness d203 of the wire crimping portion 22 in the radial direction, the occurrence of breakage was confirmed. This is thought to be because distortions produced in the wire crimping portion 22 become larger in the compressing and deforming process as the pressing amount increases.

If the pressing amount becomes smaller, the occurrence of breakage is suppressed, but it raises a possibility that electrical performance sufficient for practical use cannot be ensured. Accordingly, to ensure electrical performance, the pressing amount is desirably 10% or more of the thickness d203 of the wire crimping portion 22 in the radial direction.

<4-3. Bellmouth Portion 202>

Further, in the crimping die 3, the first multi-step inclined surface part 45 of the bottom surface 42 of the recess 41 and the second multi-step inclined surface part 55 of the upper end surface 52 of the projection 51 are respectively shaped such that the angle of inclination discontinuously changes to increase toward the end part. Accordingly, the bellmouth portion 202 formed by being sandwiched between these multi-step inclined surface parts 45, 55 is shaped to be gradually widened over multiple steps. Thus, in the process of compressing and deforming the wire crimping portion 22 and crimping and fixing it to the conductor wires 11, the bellmouth portion 202 is unlikely to be cracked or broken.

<5. Modifications>

In the crimping die 3 according to the above embodiment, the width d401 of the recess 41 and the width d501 of the projection 51 are equal to the outer diameter d201 of the wire crimping portion 22 (first configuration), the first protrusion 43 is formed on the bottom surface 42 of the recess 41 and the second protrusion 53 is formed on the upper end surface 52 of the projection (second configuration), and the first multi-step inclined surface part 45 of the bottom surface 42 of the recess 41 and the second multi-step inclined surface part 55 of the upper end surface 52 of the projection 51 are respectively shaped such that the angle of inclination discontinuously changes to increase toward the end part (third configuration). Here, the crimping die 3 needs not necessarily have all the first to third configurations.

For example, a crimping die adopting the first and second configurations (crimping die in which the widths of a recess and a projection are equal to the outer diameter d201 of the wire crimping portion 22 and protrusions for pressing are formed on the bottom surface of the recess and the upper end surface of the projection, and each inclined surface part of the bottom surface of the recess and each inclined surface part of the upper end surface of the projection are not shaped to change an angle of inclination toward an end part) is also effective. Also in this mode, it is possible to achieve a crimped and fixed state ensuring electrical performance while suppressing the occurrence of cracks and breakage to a certain extent. Note that, in this configuration, a mode in which the protrusions for pressing are not formed on the bottom surface of the recess and the upper end surface of the projection is also realizable. However, as described above, it is more preferable to form the protrusions for pressing on the bottom surface of the recess and the upper end surface of the projection in order to reliably ensure electrical performance.

For example, a crimping die adopting only the third configuration (crimping die in which one inclined surface part of the bottom surface of the recess and one inclined surface part of the upper end surface of the projection are shaped such that an angle of inclination discontinuously changes to increase toward an end part, the widths of a recess and a projection are not equal to the outer diameter d201 of the wire crimping portion 22 and protrusions for pressing are not formed on the bottom surface of the recess and the upper end surface of the projection) is also effective. In this mode, an effect that the bellmouth portion formed by being sandwiched between the multi-step inclined surface parts is unlikely to be cracked or broken is particularly obtained. Further, the third configuration can be singly adopted also in a crimping die used, for example, in crimping and fixing a terminal fitting including a wire crimping portion having a shape other than a cylindrical shape and a wire.

Although this invention has been described in detail above, the above description is illustrative in all aspects and the invention is not limited thereto. It is understood that numerous modifications, which are not illustrated, can be envisaged without departing from the scope of this invention.

What is claimed is:

1. A method for manufacturing a terminal-fitted wire by crimping and fixing a terminal fitting including a cylindrical wire crimping portion and a wire, the method comprising the steps of:

providing a first die with a concave die surface defining a recess extending in a longitudinal direction, the recess including a bottom surface with a flat surface part having a first protrusion projecting into the recess and first and second inclined surface parts spaced apart in the longitudinal direction, the first and second inclined surface parts being inclined so that the recess is deeper at the first and second inclined surface parts than at the flat surface part;

providing a second die with a convex die surface defining a projection extending in the longitudinal direction, the projection having an upper end surface with a second protrusion projecting therefrom and front and back inclined surface parts spaced apart in the longitudinal direction, the front and back inclined surface parts being inclined so that a projecting height of the projection is greatest at positions between the spaced apart front and back inclined surface parts;

arranging the first die and second die to be spaced apart with the concave die surface and the convex die surface facing each other;

inserting the wire into the cylindrical interior of the wire crimping portion;

arranging the wire crimping portion between the concave die surface and the convex die;

moving the first die towards the second die with the wire crimping portion in the recess of the concave guide surface; and compressing and deforming the wire crimping portion and crimping and fixing the wire crimping portion and the wire inserted in the cylindrical interior of the wire crimping portion by sandwiching the wire crimping portion between the concave die surface and the convex die surface so that a central portion of the wire crimping portion in a width direction of the wire crimping portion is pressed between the first and second protrusions and opposite ends of the wire crimping portion in the extending direction are widened by the first and second inclined surfaces of the first die and the front and back inclined surfaces of the second die, wherein a width of the recess on the concave die surface and that of the projection on the convex die surface are equal to an outer diameter of the wire crimping portion.

* * * * *